US007320638B2

(12) United States Patent
Craig

(10) Patent No.: US 7,320,638 B2
(45) Date of Patent: Jan. 22, 2008

(54) AIR DIFFUSER

(76) Inventor: Richard L. Craig, 3835 Deer Run, Denver, NC (US) 28037

( * ) Notice: Subject to any disclaimer, the term of this patent is extended or adjusted under 35 U.S.C. 154(b) by 0 days.

(21) Appl. No.: 11/381,190

(22) Filed: May 2, 2006

(65) Prior Publication Data

US 2007/0259617 A1 Nov. 8, 2007

(51) Int. Cl.
*F24F 7/00* (2006.01)

(52) U.S. Cl. ..... 454/290

(58) Field of Classification Search ..... 454/289, 454/290; 24/3.2, 3.12, 437, 411; 16/87 R, 16/443

See application file for complete search history.

(56) References Cited

U.S. PATENT DOCUMENTS

| | | | |
|---|---|---|---|
| 4,250,540 | A | 2/1981 | Kristofek |
| 5,109,756 | A | 5/1992 | Barboza et al. |
| 5,410,782 | A | 5/1995 | Holyoake |
| 6,050,892 | A | 4/2000 | Sodec |
| 6,083,100 | A | 7/2000 | Hardy et al. |
| 6,231,438 | B1 | 5/2001 | Laudermilk |
| 6,290,596 | B1 | 9/2001 | Birdsong et al. |
| 6,361,432 | B1 | 3/2002 | Walker |
| 6,478,673 | B1 | 11/2002 | Haynes |
| 2003/0139133 | A1* | 7/2003 | Hardy ..... 454/290 |

FOREIGN PATENT DOCUMENTS

EP 0 446 557 A2 9/1991

OTHER PUBLICATIONS

Product Brochure; DS 4074 A 11.2001—DS 4074 A BI.10; Air-conditioning Components; Technical Selection—Rotary Floor Twist Outlet DB-D-DN . . . ; Krantz Komponenten® Applied System Solutions; pp. 1-10.

Product Brochure; Air Distribution Systems; Floor Outlets; Krantz Komponenten® Applied System Solutions; pp. 1-12.

* cited by examiner

*Primary Examiner*—Steven McAllister
*Assistant Examiner*—Helena Kosanovic
(74) *Attorney, Agent, or Firm*—Alston & Bird LLP

(57) ABSTRACT

An improved air diffuser is provided, including a housing having a bottom and an upwardly extending side wall with air slots to receive air. The housing supports a grille, and a flow regulator fits within the housing. The diffuser is configured to be secured to a floor by a mounting assembly, including a trim ring and a plurality of retaining mechanisms. The trim ring defines a flange and brackets for receiving the retaining mechanisms. Each retaining mechanism defines an L-shaped mount having horizontal and vertical legs. A cantilevered latch extends from a back of the vertical leg so that, when the vertical leg is inserted into one of the brackets, the latch secures the retaining mechanism to the bracket. The horizontal leg and the flange of the trim ring define a space therebetween for engaging a floor and thereby securing the housing to the floor.

7 Claims, 2 Drawing Sheets

AIR DIFFUSER

BACKGROUND OF THE INVENTION

1. Field of the Invention

This invention relates to an air diffuser designed to regulate air flow from an under floor air distribution system. More particularly, this invention relates to a quick release latching mechanism for installing or replacing air diffuser grilles from under floor air distribution systems.

2. Description of Related Art

Presently, commercially available floor mounted air diffusers require longer to install or replace than desired. Part of the reason for the installation time is latching and/or unlatching the diffuser grille. Another disadvantage of the presently available floor mounted diffusers is adjusting the amount of air flow through the grille. The improvements of the present invention overcome both of those problems.

An example of a diffuser adapted to regulate air flow from an under floor air distribution system is described in U.S. Pat. No. 6,361,432 to Walker. A grille sets on a housing and a flow regulator that is supported by a mounting assembly in the floor. Both the housing and the flow regulator have air slots extending through their side walls to receive air from the plenum. The flow regulator can be rotated by turning the grille. The flow regulator has a series of three equally spaced arms or stops that extend inwardly from the sidewalls of the flow regulator and are joined at a central hub located near the center axis of rotation of the flow regulator. When the flow regulator is installed in the housing, an arcuate, molded-in tab or stop extends upwardly from the base of the housing between a first bar and a second bar. The arcuate width of the stop is approximately 15 degrees less than the arcuate width of the space between the first bar and the second bar. The grille and mounting assembly have indicators that give a visual indication of the portion of the floor regulator with respect to the housing, the openings of the slots, and the flow rate through the diffuser.

Another example of a diffuser for under floor air distribution is shown in U.S. Pat. No. 6,290,596 to Birdsong et al. Therein is described an air distribution system wherein the diffuser grille fits on a housing supported by a mounting assembly in the floor. The diffuser is designed to be mounted with a trim ring and a retaining ring in the floor above the air distribution plenum. A flow regulator nests insides the housing. Both the housing and the flow regulator have air slots through their side walls. Air from the plenum passes through these slots into the diffuser and is forced through the helical slots in the grille into the room above the diffuser. The air flow rate can be adjusted by rotating the flow regulator within the housing so that the slots in the flow regulator are either in or out of registry with the slots in the housing. The improvement in air distribution is the use of curved helical slots in the grille.

In yet another example, U.S. Pat. No. 6,231,438 to Laudermilk describes a floor mounted adjustable air flow assembly for use in an under floor air distribution or diffuser system. The assembly includes a circular gate housing having a cylindrical body portion, externally threaded along the lower portion, and features an outwardly directed flange to allow positioning of the circular grate housing in a floor opening in communication with the under floor plenums. Threadably engaging the lower portion of the grate housing and cooperating therewith is a flange ring including an outwardly extending rim. The flange ring threadably engages the threads to bring the rim into contact with the lower surface of a floor adjacent a floor opening, to thereby fix the circular grate housing relative to the floor.

Sodec, in U.S. Pat. No. 6,050,892 discloses an adjustable floor mounted air outlet vent includes a cylindrical housing that has air flow openings therein. The vent is adapted to be set into a floor opening and the cover plate having outlet openings therein and covering the top of the housing. The air outlet vent is secured in the opening. The grille plate has a first group of air outlet openings in the form of concentric circular arcuate slits extending over a first sector of the plate, and a second group of air outlet openings in the form of radially extending slits in a second sector of the plate. The housing mounted in the floor using a friction fit or may be equipped with a clamping member, such as a threaded clamping ring that clampingly presses against the bottom surface of the floor, or a lateral clamping wedge that pressing clampingly against the sidewalls of the opening in the floor.

U.S. Pat. No. 5,109,758 to Barboza et al. describes an adjustable air diffuser with improved method of installation. The assembly includes a plurality of tubular shaped parallel collars of different common duct sizes and arranged in an angular step configuration leaving the largest collar adjacent the mounting surface material. These collars are of sufficient length to accommodate easy duct installation. In addition to this length, the largest collar incorporates enough length to provide for a mounting clip cut out to house the mounting clip assembly.

BRIEF SUMMARY OF THE INVENTION

The present invention provides an air diffuser for under-floor air distribution. The air diffuser of the present invention, broadly speaking, includes a housing, a flow regulator, mounting mechanisms to affix the housing to the floor, a diffuser grille, and a quick release system for latching and unlatching the diffuser from the floor. A flow regulator or damper nests inside the housing. Both the housing and the flow regulator have vertically extending air slots extending through their side walls. Air from the under floor air plenum passes through these slots into the diffuser and is forced through the slots in the grille into the room above the diffuser. The air flow rate can be adjusted by rotating the flow regulator with the housing so that the slots in the flow regulator are either in or out of registry with the slots in the housing.

The diffuser is provided with a circular grille having air slots and the grille is sized to fit snuggly in the opening in the top of the housing and rest therein. The housing is mounted to a floor by a trim ring and a plurality of retaining mechanisms. The trim ring has an upright cylindrical ring that extends through a hole in the floor. The upright cylindrical ring is sized for the housing to fit therein, and an inwardly extending ledge for the housing to rest thereon. The flange extends laterally from the top of upright ring and the flange is larger than the hole in the floor and tapered to meet with the floor and form a relatively smooth meeting intersection. The outer surface of the upright ring includes a series of mechanism holding brackets. The brackets are designed to accommodate the retaining mechanisms. The edges of vertical leg of the retaining mechanism simply slide upward into the grooved slots formed by the holding brackets and held in place therein. The trim ring also contains a series of release ports through which a narrow blade or tool may be inserted to release the latch of mechanism as will be explained in greater detail.

The retaining mechanism is an L-shape element having a vertical leg and a horizontal base or leg. The vertical leg has a pair of edges at each side and is sized to be snugly fit into the holding slots of brackets. The vertical leg has a cantilevered latch attached to the back side thereof at the upper end. When inserted into bracket the bottom end of the latch rests on the ledge and serves to retain the diffuser to the floor. The horizontal base includes a plurality of spring mounts that serve to hold spring in place. The retaining mechanism slides upward into the slots in bracket until the bottom of the cantilevered latch rests on ledge. As shown there are four retaining mechanisms but it should be understood that three will properly latch the diffuser to the floor. To unlatch the diffuser a thin tool or paper clip may be inserted into the release port and pressed against the cantilevered latch until the latch is forced toward the vertical leg a sufficient amount to become dislodged from ledge.

It is the general object of the present invention to provide an improved air diffuser having a mechanism for quickly installing and replacing the diffuser.

Another object of the present invention is to provide a simple mechanism for retaining an air diffuser to a hole in a floor using the L-shaped mechanism.

A further object of the present invention is to provide a cost efficient mounting mechanism for use on floor mounted air diffusers.

These and other objects, features and advantages of the present invention will be evident from the following detailed description taken in conjunction with the drawings.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
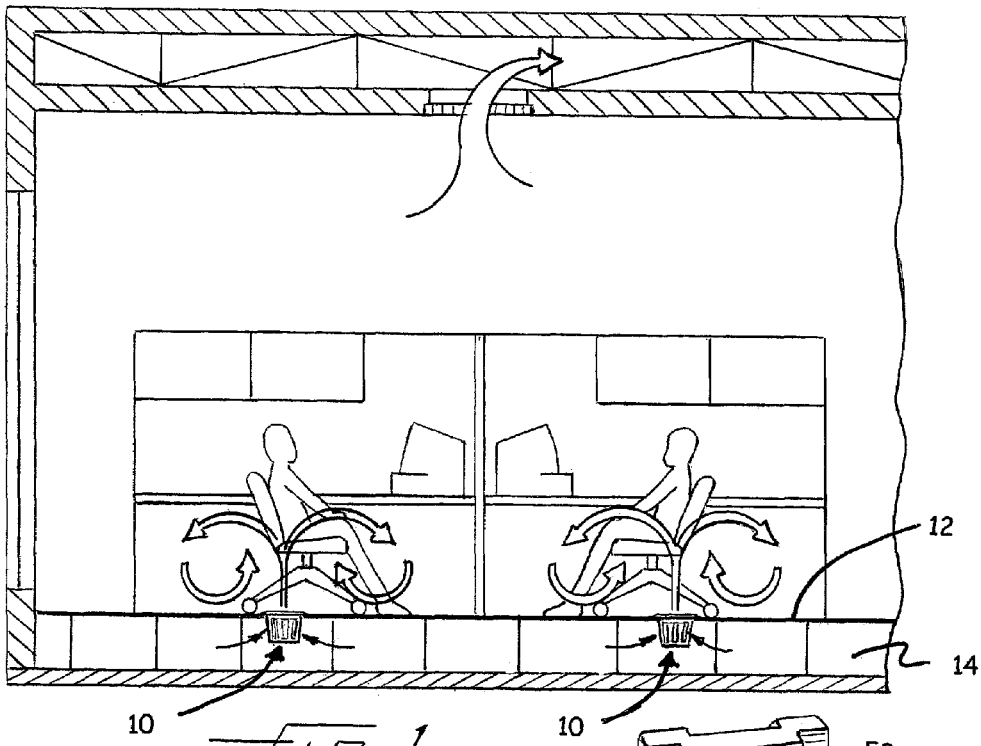
FIG. 1 is an environmental view illustrating an air diffuser of the type used with the present invention placed in an under floor air distribution system.

The invention relates to a diffuser adapted to regulate air flow from an underfloor air distribution system. FIG. 1 is an environmental view of an air diffuser 10 placed in an under floor air distribution system. As shown in FIG. 1, a housing 20 is mounted in the floor 12 above the plenum 14 of the air distribution system.

Figure 2:
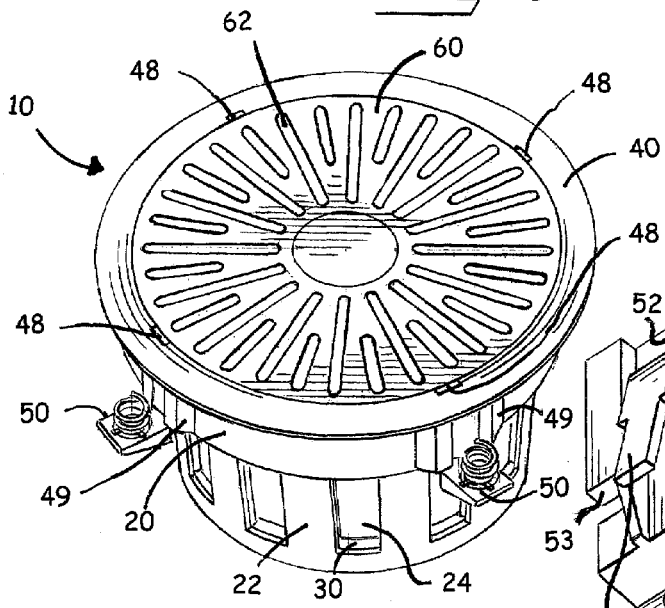
FIG. 2 is a perspective view of an under floor air diffuser embodying the diffuser mounting mechanism of this invention.

Referring now to FIG. 2 there is shown a perspective view of an under floor air diffuser embodying this invention. The diffuser 10 includes a dust receptacle or basket shaped housing 20 that supports an air distribution grille 60. The housing 20 is circular and has a bottom 28 and a side wall 22. The upper end of the housing 20 includes a flange 27 that encircles the opening at the top. Directly below the flange 27 is a series of retaining mechanism holding brackets 29 for holding retaining mechanism 50, as will be later explained.

Figure 5:
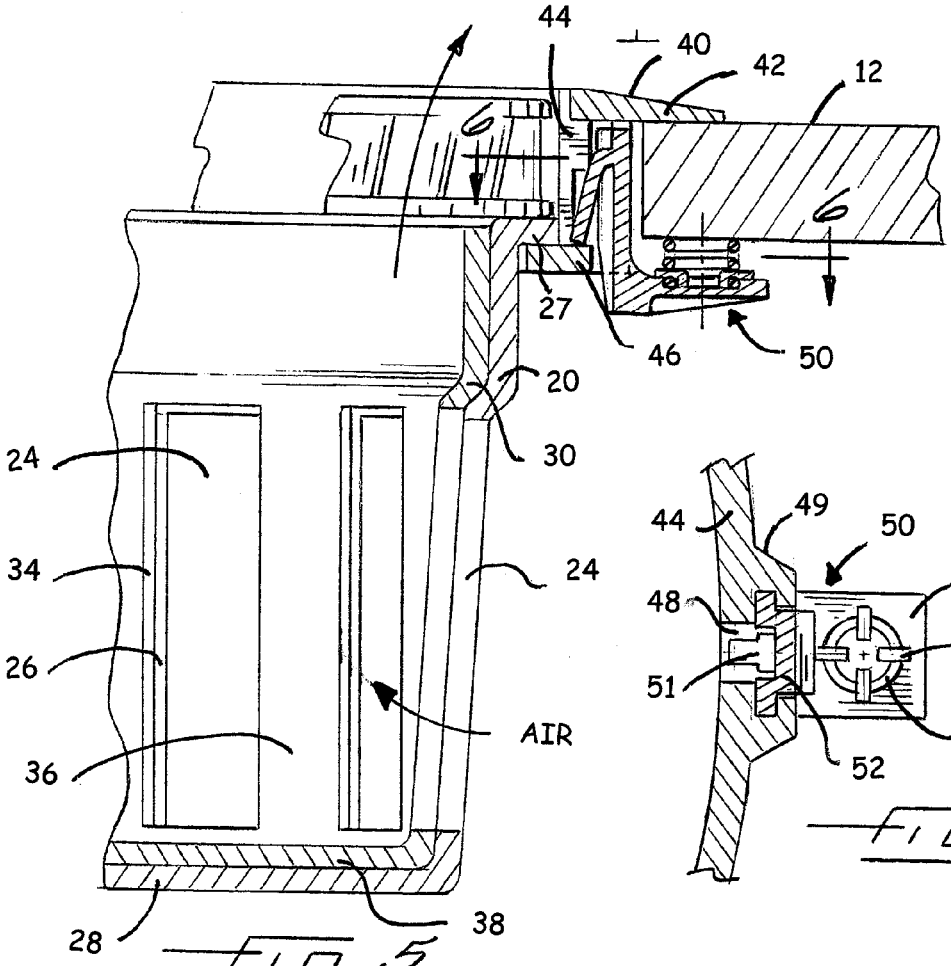
FIG. 5 is a partial cut away view of the diffuser showing a portion of the housing, the flow regulator and the mounting mechanism shown in FIG. 1 and illustrated the grille in a latched position.

As shown in FIG. 5, the diffuser 10 includes a flow regulator 30 and the side wall 32 having complementary surfaces of revolution with the housing side wall 22, such as stepped, slightly tapered cylinders or truncated cones, that allow the side wall 32 of the flow regulator to contact and rotate with respect to the side walls 22 of the housing 20. The side wall 22 of housing 20 and the side wall 32 of flow regulator 32 have a number of mating longitudinally extending air slots 24, 34 separated by solid portions 26, 36 of their respective side wall 22, 32. When the flow regulator is rotated so that the slots 34 in the flow regulator are in registry with the slots 24 in housing 20 air can flow from the under floor air plenum 14 into the diffuser into the housing and through the grille 60. This flow can be reduced or stopped by rotating the flow regulator 30 so that solid portions 36 of the flow regulator side wall 32 partially or totally cover the air slots 24 in the housing. The flow regulator 30 is provided with a plurality of equally spaced support arms 38 forming an open bottom that act as stops that extend inwardly from the side wall 32 of the flow regulator 30 and are joined at a central hub located at or near the central axis of rotation of the flow regulator 30. When the flow regulator is installed in the housing, a stop extends upwardly from the interior of the bottom 28 of the housing between two of the support arms 38. The arcuate width of the stop may be formed or adjusted to provide a predetermined amount of rotation of the flow regulator 30 within the housing.

The diffuser is provided with a circular grille 60 having air slots 62. The grill is sized to fir snuggly in the opening in the top of the housing 20 and rest on housing flange 24. As will be understood by those skilled in the art that the air slots may have numerous configurations.

The housing 20 is mounted to a floor 12 by a trim ring 40 and a plurality of retaining mechanism 50, described in more detail below. As shown in FIG. 5, the diffuser 10 is designed to be mounted, with the trim ring 40 and retaining mechanism 50, in a hole in the floor 12 above an air distribution plenum 14.

Figure 6:
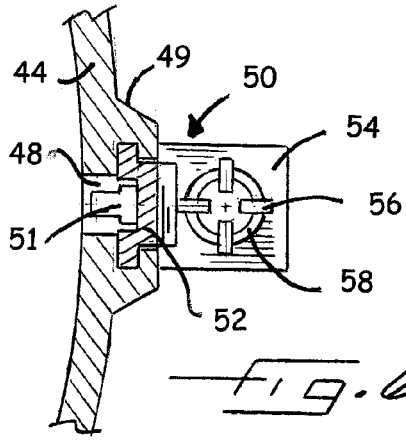
FIG. 6 is a top view of the mounting mechanism of this invention taken along line 6-6 of FIG. 5.

Referring to FIG. 5, trim ring 40 has an upright cylindrical ring 44 that extends through a hole in the floor 12. The upright cylindrical ring 44 is sized for the housing 20 to fit therein, and an inwardly extending ledge 46 for the housing to rest thereon. The flange 42 extends laterally from the top of upright ring 44 and the flange is larger than the hole in the floor and tapered to meet with the floor and form a relatively smooth meeting intersection, to provide a clean and asthetically pleasing appearance. As shown in FIG. 2 the outer surface of upright ring 44 includes a series of mechanism holding brackets 49. The brackets 49 (forming a female receptor) are designed to accommodate the retaining mechanisms 50. As shown in FIG. 6, the edges 53 of vertical leg 52 (male receptor) of the retaining mechanism 50 simply slides upward into the grooved slots of the female receptor formed by the brackets 49 and is securely locked in place therein. The trim ring 40 also contains a series of release ports 48 through which a narrow blade or tool may be inserted to release the latch of mechanism 50 as will be explained in greater detail. The release ports 48 are located in the flange 42 above each bracket 49.

Figure 3:
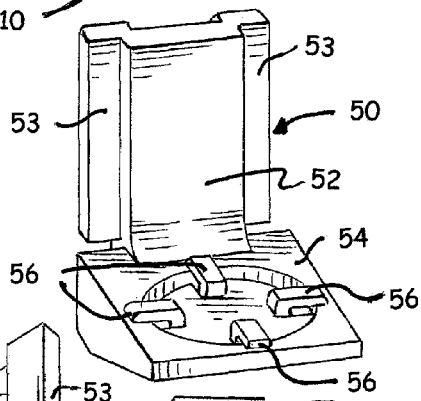
FIG. 3 is a front view of the mounting mechanism of this invention without the spring.
Figure 4:
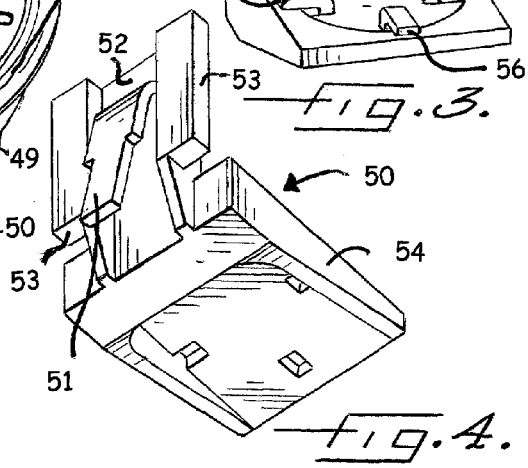
FIG. 4 is a rear view of the mounting mechanism of the present invention.
Figure 7:
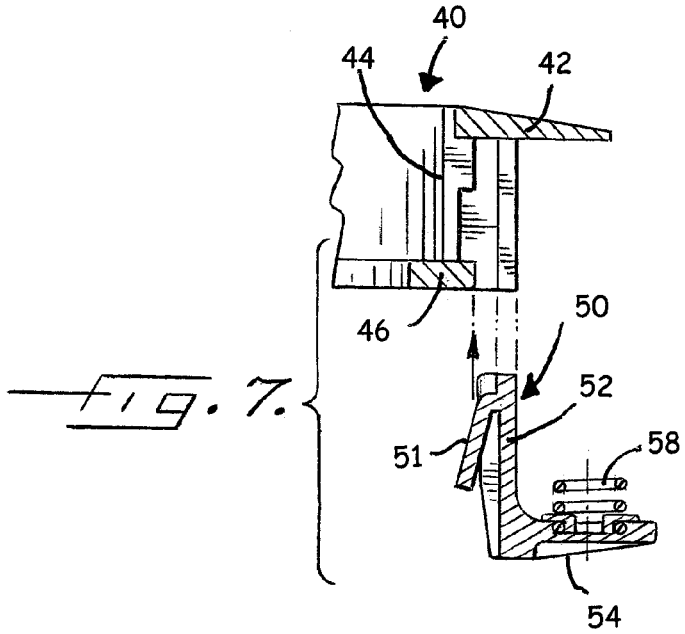
FIG. 7 is a side view of the latching mechanism of this invention.

FIGS. 3 and 4 show the retaining mechanism 50 as an L-shape element having a vertical leg 52 and a horizontal base or leg 54. The vertical leg 52 has a pair of edges 53 at each side of the vertical portion and sized to be snugly fit into the holding slots of brackets 49. The vertical leg 52 has a cantilevered latch 51 attached to the back side thereof at the upper end. When inserted into bracket 49 the bottom end of latch 51 rests on ledge 46 and serves to retain the diffuser to the floor. The horizontal base 54 includes a plurality of spring mounts 56 that serve to hold spring 58 in place. The L-shaped element with spring 58 serves to automatically hold the diffuser housing 20 tightly against flooring of different thicknesses. Because the spring is used the diffuser may be used with floors of varying thicknesses, both the currently available 1" and ⅞" flooring panels. The retaining mechanism, as shown in FIG. 7 slides upward into the slots in bracket 49 until the bottom of the cantilevered latch rests on ledge 46. As shown there are four retaining mechanisms but it should be understood that three will properly latch the diffuser to the floor. To unlatch the diffuser a thin tool or paper clip may be inserted into the release port 48 and pressed against the cantilevered latch 51 until the latch is forced toward the vertical leg a sufficient amount to become dislodged from ledge 46.

The trim ring and retaining mechanism are designed so that the entire installation process can be performed from above the floor, which shortens installation and relocation of the diffusers substantially. This diffuser can be installed in less than 1 minute, whereas installation of prior art diffusers that required parts of the installation to be performed from beneath the floor typically required at least 5 minutes. In an office building with many diffusers, the time savings are significant.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An air diffuser comprising:

a housing having a bottom and an upwardly extending side wall having air slots extending through said side wall to receive air;

a rotatable flow regulator fining within and complementary to the sidewall of said housing and having air slots extending through side flow regulator sidewall;

a mounting assembly comprising a trim ring and a plurality of retaining mechanisms, the trim ring defining a flange and a plurality of brackets for receiving the retaining mechanisms, each retaining mechanism defining an L-shaped mount having a horizontal leg, a vertical leg, and a cantilevered latch attached to the vertical leg extending from a back of the vertical leg opposite the horizontal leg, the L-shaped mount being configured so that, when the vertical leg is inserted into one of the brackets, the cantilevered latch secures the retaining mechanism to the bracket and the horizontal leg and the flange of the trim ring define a space therebetween for engaging a floor and thereby securing the housing to the floor; and a grille having air slots therein supported by and adapted to rotate with respect to said housing.

2. The air diffuser according to claim 1 wherein the horizontal leg of said retaining mechanism includes spring holding means and a spring for applying pressure to retain the housing against said floor when said mechanism is installed.

3. The air diffuser according to claim 1 wherein said flange of said trim ring extends outwardly, and said trim ring further comprises an upright circular ring, and an inwardly extending circular ledge.

4. The air diffuser according to claim 3 wherein said trim ring further includes a release port for each retaining mechanism.

5. An air diffuser configured to be retained to a hole in a floor, the air diffuser comprising:

a housing having a bottom and an upwardly extending side wall having air slots extending through said side wall to receive air;

a rotatable flow regulator fitting within and complementary to the sidewall of said housing and having air slots extending through side flow regulator sidewall;

a trim ring comprising:

an upright cylindrical ring configured to extend through the hole in the floor and sized to receive the housing;

a ledge extending inwardly from the upright cylindrical ring and configured to support the housing in the upright cylindrical ring; and a flange extending outwardly from the top of upright ring, the flange being larger than the hole in the floor, wherein the outer surface of the upright ring defines a plurality circumferentially spaced brackets, each bracket defining a grooved slot;

a plurality of retaining mechanisms configured to be slidingly received by the grooved slots of the brackets of the trim ring, each retaining mechanism defining an L-shaped mount having a horizontal leg, a vertical leg, and a cantilevered latch attached to the vertical leg extending from a back of the vertical leg opposite the horizontal leg, the L-shaped mount being configured so that, when the vertical leg is inserted into one of the slots of the brackets, the cantilevered latch engages the bracket radially inward of the vertical leg to secure the retaining mechanism to the trim ring, with the horizontal leg extending radially outward from the vertical leg such that the horizontal leg and the flange of the trim ring define a space therebetween for engaging the floor and thereby securing the housing to the floor; and a grille having air slots therein supported by and adapted to rotate with respect to said housing.

6. The air diffuser according to claim 5 wherein the horizontal leg of said retaining mechanism includes spring holding means and a spring for applying pressure to retain the housing against said floor when said mechanism is installed.

7. The air diffuser according to claim 5 wherein said trim ring further includes a release port for each retaining mechanism.

* * * * *

UNITED STATES PATENT AND TRADEMARK OFFICE

CERTIFICATE OF CORRECTION

PATENT NO. : 7,320,638 B2
APPLICATION NO. : 11/381190
DATED : January 22, 2008
INVENTOR(S) : Craig It is certified that error appears in the above-identified patent and that said Letters Patent is hereby corrected as shown below:

Column 5,

Line 56, "fining" should read --fitting--.

Signed and Sealed this

Third Day of June, 2008

JON W. DUDAS
*Director of the United States Patent and Trademark Office*